US005930999A

United States Patent [19]

Howell et al.

[11] Patent Number: 5,930,999

[45] Date of Patent: Aug. 3, 1999

[54] FUEL INJECTOR AND MULTI-SWIRLER CARBURETOR ASSEMBLY

[75] Inventors: Stephen J. Howell, Georgetown; Joseph D. Cohen, Danvers, both of Mass.

[73] Assignee: General Electric Company, Cincinnati, Ohio

[21] Appl. No.: 08/899,116

[22] Filed: Jul. 23, 1997

[51] Int. Cl.[6] ..... F23R 3/14

[52] U.S. Cl. ..... 60/737; 60/748; 60/746; 239/402

[58] Field of Search ..... 60/39.49, 737, 60/746, 748, 743, 742, 739; 239/402, 403, 404, 466

[56] References Cited

U.S. PATENT DOCUMENTS

| | | | |
|---|---|---|---|
| Re. 30,160 | 11/1979 | Emory, Jr. et al. | 60/739 |
| 2,583,416 | 1/1952 | Clarke et al. | 60/746 |
| 2,595,765 | 5/1952 | Clarke et al. | 60/746 |
| 3,236,048 | 2/1966 | Spears | 60/746 |
| 3,834,159 | 9/1974 | Vdoviak | 60/746 |
| 3,937,011 | 2/1976 | Caruel et al. | 60/737 |
| 3,968,644 | 7/1976 | Fehler | 60/746 |
| 4,260,367 | 4/1981 | Markowski et al. | 60/742 |
| 5,437,158 | 8/1995 | Fric | 60/743 |
| 5,675,971 | 10/1997 | Angel et al. | 60/746 |

*Primary Examiner*—Ted Kim
*Attorney, Agent, or Firm*—Andrew C. Hess; Rodney M. Young

[57] ABSTRACT

A gas turbine engine carburetor includes a fuel injector having a plurality of circumferentially spaced apart fuel outlets. A plurality of air swirlers (24) are circumferentially spaced apart around the fuel injector (22), with each swirler having a fuel inlet (24*b*) disposed in flow communication with a respective one of the fuel outlets for receiving fuel therefrom. Each swirler includes a plurality of swirl vanes to swirl air for mixing with the fuel from the fuel inlets. The multi-swirler carburetor having a common fuel injector increases injection points for reducing $NO_x$ emissions.

18 Claims, 4 Drawing Sheets

FUEL INJECTOR AND MULTI-SWIRLER CARBURETOR ASSEMBLY

BACKGROUND OF THE INVENTION

The present invention relates generally to gas turbine engines, and, more specifically, to low $NO_x$ combustors therefor.

A gas turbine engine includes a combustor having a plurality of fuel injectors typically cooperating with air swirlers which mix fuel and air to form a suitable fuel/air mixture which is ignited for generating hot combustion gases. The products of combustion include various undesirable emissions such as smoke or hydrocarbons, carbon monoxide, and nitrogen oxides ($NO_x$) These emissions are dependent in part on the richness or leanness of the fuel/air mixture and are typically mutually exclusive increasing the difficulty of achieving a suitable combustor design.

Furthermore, in a gas turbine engine configured for powering an aircraft in flight, the engine and combustor operate over varying power levels and temperature and require corresponding design for achieving stable combustor operation. Many fuel injection points are provided around the circumference of the combustor which affects the circumferential and radial temperature distribution of the combustion gases discharged to a high pressure turbine which extracts energy therefrom. The circumferential temperature distribution is typically represented by a conventional pattern factor, and the radial temperature distribution is represented by a conventional profile factor.

Additional combustor design considerations include fuel thermal breakdown and coking of the fuel injectors due to the temperature environment of the fuel injector And, autoignition, flashback, and flammability are additional design considerations for obtaining a suitable combustor in a gas turbine engine.

It is desired to further reduce $NO_x$ emissions in a gas turbine engine combustor without adversely affecting performance of the combustor under these other operating parameters.

SUMMARY OF THE INVENTION

A gas turbine engine carburetor includes a fuel injector having a plurality of circumferentially spaced apart fuel outlets. A plurality of air swirlers are circumferentially spaced apart around the fuel injector, with each swirler having a fuel inlet disposed in flow communication with a respective one of the fuel outlets for receiving fuel therefrom. Each swirler includes a plurality of swirl vanes to swirl air for mixing with the fuel from the fuel inlets. The multi-swirler carburetor having a common fuel injector increases injection points for reducing $NO_x$ emissions.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
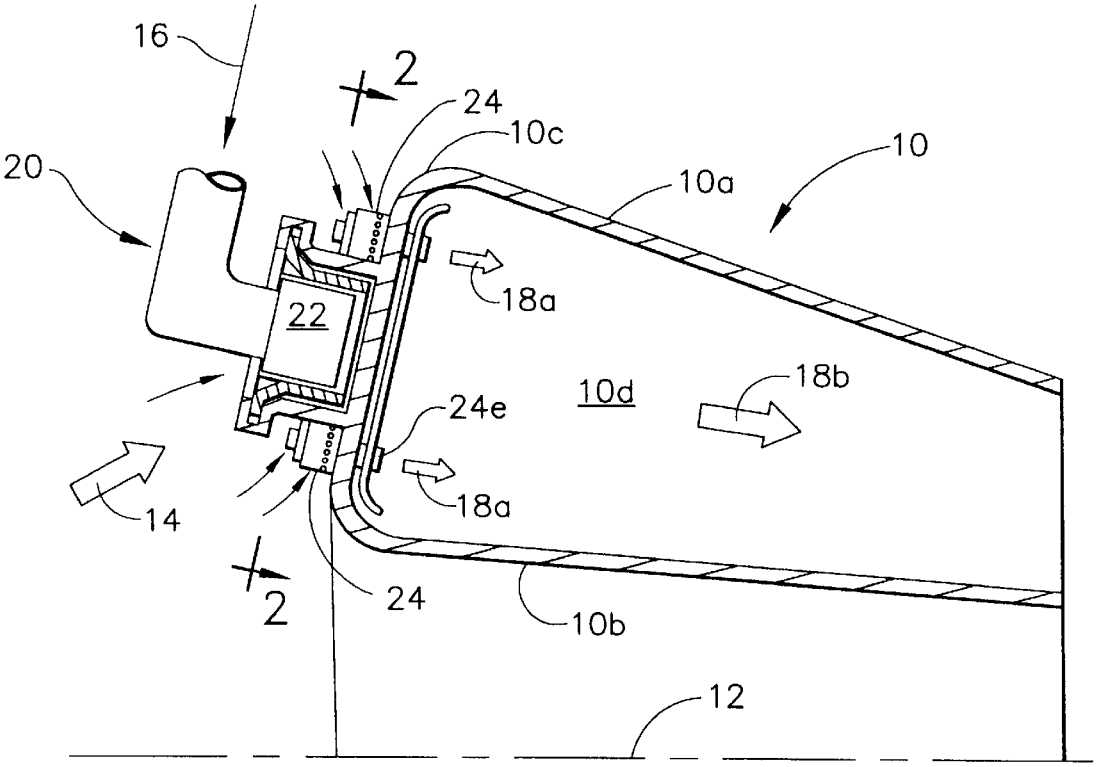
FIG. 1 is a schematic, partly sectional axial view of a portion of a gas turbine engine annular combustor having a plurality of circumferentially spaced apart carburetors for reducing $NO_x$ emissions in accordance with one embodiment of the present invention.

Illustrated schematically in FIG. 1 is an exemplary annular combustor 10 of a gas turbine engine having an axial centerline axis 12. The combustor 10 may take any conventional form including a pair of radially outer and inner annular combustion liners 10*a,b* joined together at an upstream annular dome 10*c*, with the liners 10*a,b* being spaced radially apart to define an annular combustion chamber or zone 10*d*.

Disposed upstream of the combustor 10 is a conventional compressor (not shown) which provides pressurized air 14 to the combustor 10 wherein it is mixed with fuel 16 to form a fuel and air mixture 18*a* which is suitably ignited for generating hot combustion gases 18*b* in the combustion zone 10*d*. The combustion gases 18*b* are discharged from the combustor 10 and flow to one or more turbine stages (not shown) which extract energy therefrom for powering the engine and producing useful work for either powering an aircraft in flight, or for marine or industrial applications.

In accordance with the present invention, the combustor 10 includes a plurality of circumferentially spaced apart carburetors 20 which mix the compressed air 14 and fuel 16 to provide a larger plurality of injection points for the resulting fuel and air mixtures 18*a* therefrom for reducing $NO_x$ emissions.

The fuel 16 is typically in liquid form, atomized by air in the carburetor, and produces in the combustion zone 10*d* a diffusion flame during operation. It is conventionally known that $NO_x$ emissions can be reduced by reducing exposure time within the near stoichiometric flame temperature region. This is typically accomplished by obtaining lean mixtures of low fuel drop size and low characteristic flame lengths in correspondingly short combustors.

It is recognized in accordance with the present invention that flame length is proportional to recirculation zone length within the combustor which in turn is proportional to swirler diameter. Since swirler diameter is proportional to the square root of swirler flow, a halving of $NO_x$ emissions may be accomplished by a four-fold increase in the number of injection points within the combustor, with all else being equal. Further reduction in $NO_x$ emissions may be obtained by narrow focus swirlers with collapsed sprays, low drop size, and well distributed lean mixtures.

However, substantial problems are associated with a significant increase in the number of conventional fuel injectors within the combustor which include a forest of fuel injector stems which produce undesirable airflow blockage and weight. The increased number of fuel injectors must necessarily apportion the total amount of required fuel flow, which in turn reduces fuel flow to each of the fuel injectors and leads to thermal breakdown and coking. The additional fuel injectors must extend through corresponding perforations in the surrounding combustor casing which correspondingly reduces the structural integrity thereof. A significant increase in both cost and weight of the fuel system would also result.

In accordance with the present invention, these problems are eliminated while effecting reduced $NO_x$ emissions by using common fuel injectors with associated plural air swirlers therewith.

Figure 2:
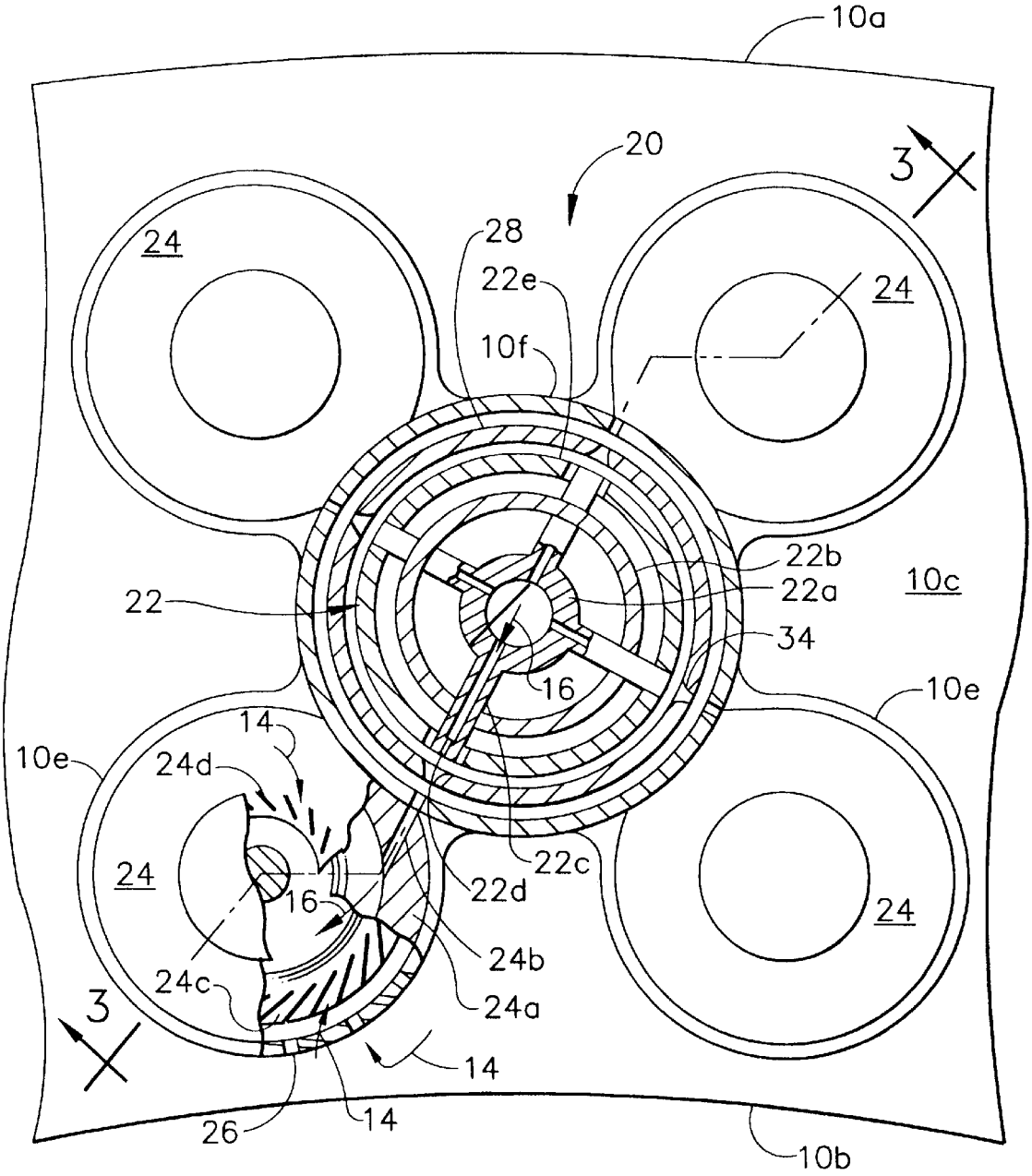
FIG. 2 is a partly sectional, aft facing view through an exemplary one of the carburetors illustrated in FIG. 1 and taken along line 2—2.

More specifically, and referring initially to FIG. 1, each of the carburetors 20 includes a respective, single fuel injector 22 which feeds the fuel 16 to a plurality of fuel-atomizing air swirlers 24 circumferentially spaced around the common fuel injector 22. As shown in more detail in FIGS. 2 and 3, four swirlers 24 cooperate with the common fuel injector 20, although two, three, or more swirlers 24 could otherwise be associated with a common fuel injector 22. In practice, identical carburetors 20 like that illustrated in FIG. 2 are circumferentially spaced apart from each other around the circumference of the combustor dome 10*c*, with the individual swirlers 24 being circumferentially spaced apart around each of the corresponding fuel injectors 22. In this way, each fuel injector 22 provides a corresponding plurality of circumferential fuel-and-air injection points spaced circumferentially along the combustor dome 10*c* for reducing $NO_x$ emissions.

Typical carburetors include a single fuel injector cooperating with a single air swirler for providing a single injection point which would experience the problems disclosed above if the increased number of injection points were obtained by simply increasing the number of fuel injectors and cooperating swirlers. By instead increasing the number of swirlers 24 associated with each fuel injector 22, $NO_x$ reduction may be achieved without undesirably increasing the number of fuel injectors themselves, thusly avoiding the above mentioned problems.

Referring again to FIGS. 2 and 3, each fuel injector 22 includes a central, hollow stem 22*a* through which the fuel 16 is provided from a conventional fuel supply (not shown). The fuel stem 22*a* is conventionally thermally insulated by using a tubular heat shield 22*b* spaced radially outwardly therefrom to provide an air-insulating gap therebetween. The distal, tip end of the fuel stem 22*a* is closed, and includes a plurality of hollow pipes or spokes 22*c* extending radially outwardly from the stem 22*a* and in flow communication therewith. Each of the spokes 22*c* includes a fuel outlet 22*d* disposed at respective distal or outer ends thereof, which is shown in more detail in FIG. 4. Preferably there is a single spoke 22*c* and fuel outlet 22*d* extending from the common stem 22*a* for each of the respective swirlers 24 to separately channel a portion of the fuel 16 thereto.

Figure 3:
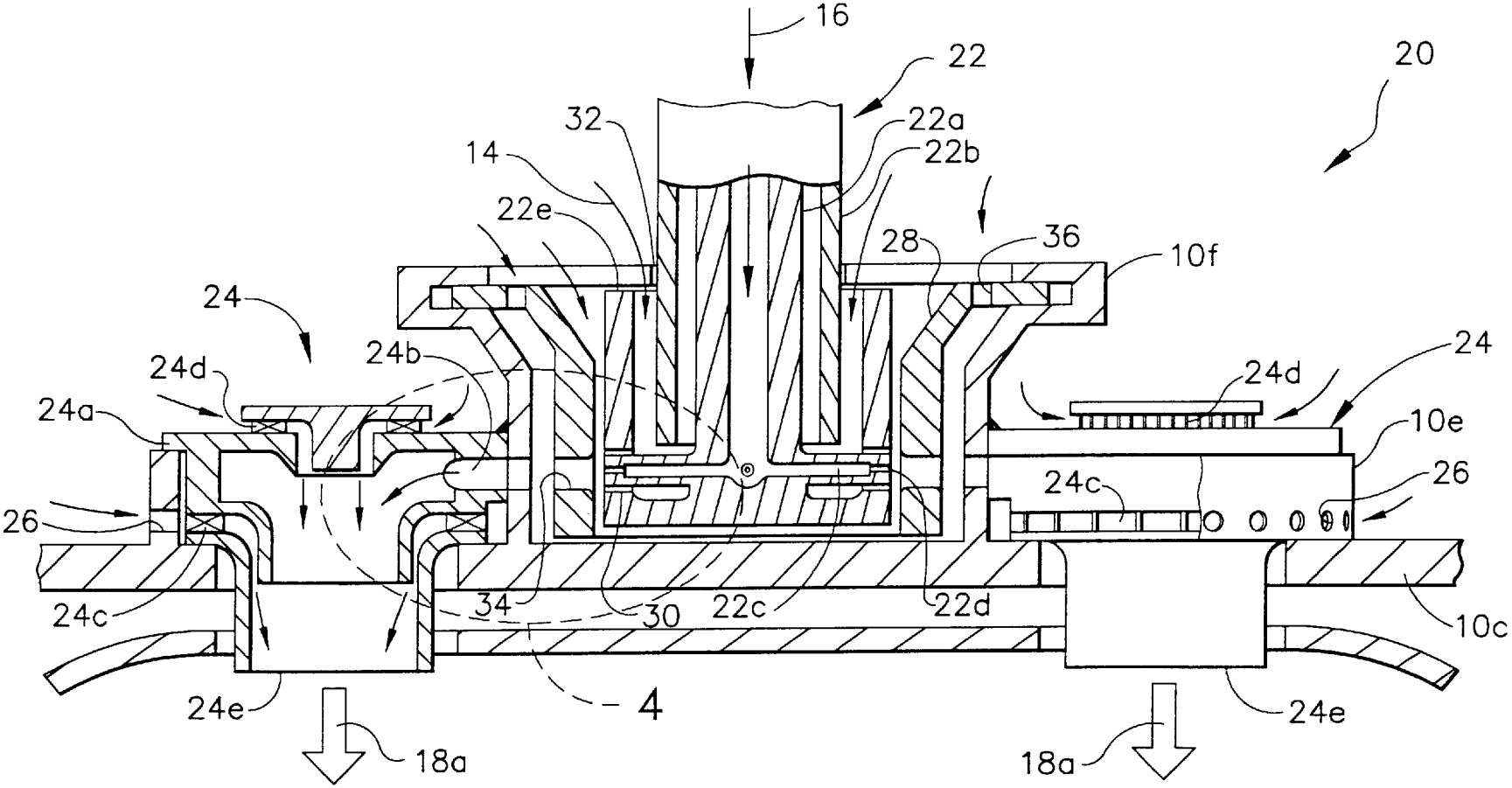
FIG. 3 is a partly sectional view through the carburetor illustrated in FIG. 2 and taken along line 3—3.

Each of the swirlers 24 includes a tubular body 24*a* as illustrated in FIG. 3 which may be formed by conventional casting along with its integral components described below in a manner similar to conventional air swirlers, but modified for use in the present invention. Each tubular body 24*a* includes a cylindrical fuel inlet 24*b* extending radially therethrough in flow communication with a respective one of the fuel outlets 22*d* for receiving the fuel 16 therefrom. As shown in FIG. 2, each of the swirler fuel inlets 24*b* preferably extends generally tangentially through the body 24*a* to swirl or spiral the fuel inside the body 24*a* in a first rotational direction shown clockwise in FIG. 2.

Figure 4:
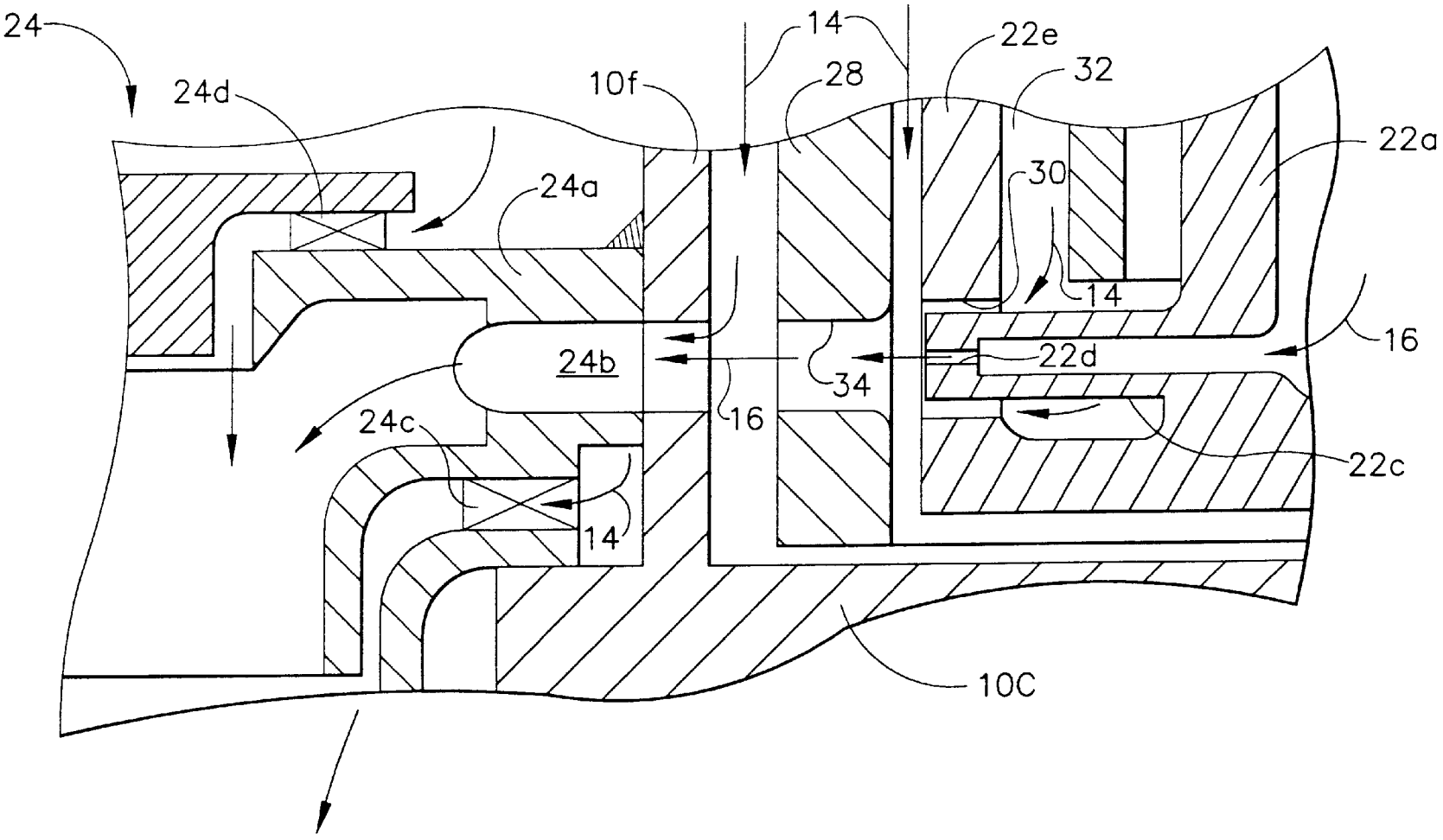
FIG. 4 is an enlarged sectional view of a portion of the carburetor illustrated in FIG. 3 within the dashed circle labeled 4.

As shown in FIGS. 2–4, each of the swirlers 24 includes a plurality of circumferentially spaced apart, stationary first swirl vanes 24*c* to swirl a portion of the compressed air 14 for mixing with the fuel 16 from the fuel inlet 24*b* to form and then discharge from the swirler 24 a fuel and air mixture 18*a*.

The swirl vanes 24*c* are arranged in a first row to define a first air inlet of each of the swirlers 24, and are disposed coaxially with the swirler body 24*a* for swirling a respective portion of the air 14 inside the center channel of the body. In the preferred embodiment illustrated in FIG. 2, the first swirl vanes 24*c* are inclined tangentially to swirl the air 14 therethrough in a second, or counterclockwise rotational direction, opposite to the first direction for the fuel 16.

Also in the preferred embodiment, a plurality of circumferentially spaced apart second swirl vanes 24*d* are disposed coaxially with the body 24*a* in another row defining a second air inlet of each swirler 24. As shown in FIG. 3, the second swirl vanes 24*d* are spaced axially forwardly or upstream from the first swirl vanes 24*c* for swirling another portion of the air 14 into the body 24*a*. The second swirl vanes 24*d* are preferably inclined tangentially oppositely to the first swirl vanes 24*c* to swirl the air 14 therethrough in the first rotational direction for obtaining counter-swirl.

As shown in FIG. 3, the swirler fuel inlet 24*b* is preferably disposed axially between the rows of first and second swirl vanes 24*c,d* for injecting the fuel therebetween for mixing therewith and ejection from a common outlet 24*e* of the swirler body 24*a* as the fuel and air mixture 18*a*.

As shown in FIG. 3, the fuel stem 22*a* has a suitable inner diameter for providing a sufficient total flowrate of the fuel 16 which is divided between the several fuel spokes 22*c*. The fuel is suitably metered by the size of the fuel outlets 22*d* in a simple orifice configuration. If desired, a conventional spin disk or series orifice arrangement may instead be used in designs having relatively low flow numbers for metering the fuel. The air 14 provided in each swirler 24 is metered by the respective air inlets defined by the first and second swirl vanes 24*c,d*. In this way, a suitably lean fuel and air mixture 18*a* may be obtained from each of the swirlers 24 for increasing the number of mixture injection points associated with a common fuel injector 22.

As indicated above, swirlers are conventionally known including counter-rotational swirlers of the general type illustrated in FIG. 3. A conventional swirler, however, typically mounts its fuel injector coaxially therein at a forward end thereof. The swirlers 24 illustrated in FIG. 3 are suitably modified to block the forward end thereof, and providing a circumferential air inlet using the second swirl vanes 24*d*. The swirler fuel inlet 24*b* is provided to the side of the swirler body 24*a* axially between the first and second swirl vanes 24*c,d*. The swirlers 24 may be otherwise conventional in configuration, and conventionally manufactured in a common casting for example.

As shown in FIG. 3, each of the swirlers 24 is suitably fixedly joined to the combustor dome 10*c* by brazing or welding, for example. In the exemplary embodiment illustrated in FIG. 3, the combustor includes a plurality of integral tubular pockets 10*e* formed on the forward side of the combustor dome 10*c* in which each of the respective swirlers 24 may be mounted. Each pocket 10*e* includes a plurality of circumferentially spaced apart air holes 26 aligned with the first swirl vanes 24*c* for admitting the air 14 thereto.

Also shown in FIG. 3, is a tubular retainer 10*f* extending integrally outwardly from the forward side of the combustor dome 10*c* centered within the pockets 10*e* for mounting the fuel injector 22 in a floating arrangement to the combustor dome 10*c*. A tubular ferrule 28 is disposed between the retainer 10*f* and the fuel injector 22 for mounting the fuel injector 22 to the combustor dome 10*c* in a conventional floating arrangement. The fuel injector 22 is allowed to slide axially inside the ferrule 28, and the ferrule 28 includes a radial flange at one end which is circumferentially trapped in a corresponding groove at the forward end of the retainer 10*f* for allowing differential radial movement therebetween. In this way, the combustor dome may be designed specifically for the improved carburetors 20, without requiring design changes in the combustor casing through which the fuel stems are mounted.

As shown in FIG. 3, the fuel injector 22 preferably further includes an integral sleeve 22*e* formed at its distal end for surrounding the fuel spokes 22*c*. The sleeve 22*e* includes a plurality of circumferentially spaced apart access ports 30, shown in more particularity in FIG. 4, which extend radially through the sleeve for receiving respective ones of the fuel spokes 22*c* and outlets 22*d* thereof. As shown in FIG. 3, the sleeve 22*e* is spaced radially outwardly from the heat shield 22*b* surrounding the fuel stem 22*a* to define an annular sleeve inlet 32 at the distal or outer end of the sleeve, with the proximal or inner end of the sleeve being integrally joined with the tip of the stem 22*a*. In this way, the sleeve inlet 32 receives and channels another portion of the compressed air 14 through the sleeve ports 30 and around the individual fuel outlets 22*d*. The sleeve ports 30 are suitably sized for metering the air 14 therethrough which initially mixes with the fuel 16 being discharged from the fuel outlet 22*d*.

As shown in FIG. 4, the ferrule 28 includes a plurality of circumferentially spaced apart access ports 34 extending radially therethrough in alignment with respective ones of the fuel outlets 22*d* at one end, and the fuel inlets 24*b* of the swirlers 24 at an opposite end for channeling fuel therebetween. The ferrule ports 34 are suitably large and have a bellmouth shape for receiving both the fuel 16 from the fuel outlets 22*d*, and the surrounding air 14 from the sleeve ports 30.

As shown in FIG. 3, a plurality of air holes 36 are disposed around the circumference of the floating flange of the ferrule 28 for providing flow communication between the ferrule 28 and the concentric retainer 10*f* for allowing purge flow therebetween.

In operation, fuel 16 is channeled through the insulated fuel stem 22*a* to each of the fuel spokes 22*c* which distribute the fuel to the respective swirlers 24. The fuel is ejected from the fuel outlets 22*d* at the end of each spoke and is metered thereby and is directed radially through the aligned holes in the sleeve 22*e*, ferrule 28, retainer 10*f*, and into the respective fuel inlets 24*b* in each of the swirlers 24. Air enters each of the swirlers 24 through the two rows of swirl vanes 24*c,d* for mixing with and further atomizing the fuel 16 injected therein through the fuel inlets 24*b*. The swirlers 24, including their vanes 24*c,d*, may be conventionally configured for co-rotation or counter-rotation airflow for mixing with the injected fuel to provide relatively low drop size fuel and lean fuel/air mixtures 18*a* discharged therefrom. The swirlers 24 may be configured for narrowly focusing the fuel and air mixtures 18*a* with collapsed sprays and well distributed lean mixtures for further reducing $NO_x$ emissions.

Reduced $NO_x$ emissions may therefore be obtained without an increase in the number of fuel injector stems 22*a*, which avoids an increase in complexity, cost, and weight if more fuel stems were otherwise used. Fewer fuel stems 22*a* requires fewer perforations through the combustor casing and reduces the likelihood of undesirable fuel coking. The carburetors 22 provide relatively simple airblast atomization having plain jet injection of the fuel 16 between the injector fuel outlets 22*d* and the swirler fuel inlet 24*b*. And, the swirlers 24 include conventional pre-filming tubular surfaces therein for enhanced atomization.

The increased number of injection points provided by the multiple swirlers 24 with the common fuel injectors 22 provides an improved mechanism for correspondingly reducing $NO_x$ emissions and, a lower pattern factor may be achieved with the increased number of injection points. If desired, the profile factor may be varied or trimmed in the radial direction by incorporating different sizing in the swirlers and injector fuel outlets 22*d* for adjusting the corresponding fuel and air mixtures 18*a* from each of the swirlers.

Furthermore, if desired, suitable fuel staging may be incorporated into the fuel stems 22*a* for separately controlling the fuel delivery to each of the radial spokes 22*c*.

In the exemplary embodiment illustrated in FIG. 3, the individual swirlers 24 are fixedly joined to the combustor dome 10*c*, with the fuel injector 22 being mounted in a floating arrangement thereto. If desired, the several swirlers 24 associated with each fuel injector 22 may be joined together and collectively joined to the combustor dome 10*c* in a suitable floating arrangement relative thereto instead of being fixed thereto. In this way, the floating ferrule 28 may be eliminated, and the fuel injector 22 instead mounted directly to the floating swirler assembly associated therewith.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A carburetor comprising:

a fuel injector terminating at a closed distal end, and having a plurality of circumferentially spaced apart fuel outlets extending radially at said distal end; and a plurality of air swirlers circumferentially spaced apart around said fuel injector, and each having a radial fuel inlet disposed in flow communication with a respective one of said fuel outlets for receiving fuel radially therefrom, and each having a plurality of swirl vanes to swirl air for mixing with said fuel from said fuel inlet inside each said swirler.

2. A carburetor according to claim 1 wherein said fuel injector further comprises a hollow stem for channeling said fuel, and a plurality of hollow spokes extending radially outwardly from said stem and in flow communication therewith, and said fuel outlets are disposed at respective outer ends of said spokes.

3. A carburetor according to claim 2 wherein each of said swirlers further comprises:

a tubular body including said fuel inlet extending radially therethrough;

a row of first swirl vanes disposed coaxially with said body for swirling a portion of said air into said body;

a row of second swirl vanes disposed coaxially with said body and spaced from said first swirl vanes for swirling another portion of said air into said body; and said fuel inlet is disposed axially between said rows of first and second swirl vanes for injecting said fuel therebetween for mixing therewith and ejection from a common outlet of said body as a fuel and air mixture.

4. A carburetor according to claim 3 wherein said fuel injector further comprises an integral sleeve surrounding said fuel spokes, and having a plurality of access ports extending radially therethrough for receiving respective ones of said fuel outlets, said sleeve being spaced from said fuel injector to define an annular inlet for receiving and channeling another portion of said air through said sleeve ports and around said fuel outlets.

5. A carburetor according to claim 4 further comprising a tubular ferrule surrounding said injector sleeve for mounting said fuel injector to a combustor dome, said ferrule including a plurality of circumferentially spaced apart access ports extending radially therethrough in alignment with respective ones of said fuel outlets for channeling fuel therebetween.

6. A carburetor according to claim 5 wherein said swirler fuel inlets extend tangentially through said body to spiral said fuel therein in a first rotational direction.

7. A carburetor according to claim 6 wherein said first swirl vanes are inclined to swirl said air therethrough in a second rotational direction, opposite to said first direction, and said second swirl vanes are inclined to swirl said air therethrough in said first rotational direction.

8. A carburetor according to claim 5 in combination with a combustor dome, with said swirlers being fixedly joined thereto, and said ferrule being slidingly joined thereto for allowing said fuel injector to float relative to said combustor dome.

9. An apparatus according to claim 8 wherein said swirlers are spaced apart circumferentially in said combustor dome for providing a plurality of circumferential injection points therealong from said common fuel injector.

10. An apparatus according to claim 8 further comprising an annular retainer joined to said combustor dome, and receiving said ferrule therein.

11. An apparatus comprising:

an annular combustor having a dome;

a plurality of fuel injectors circumferentially spaced apart from each other through said dome, and each injector terminating at a closed distal end, and having a plurality of circumferentially spaced apart fuel outlets extending radially at said distal end; and respective pluralities of air swirlers circumferentially spaced apart around each of said injectors, with each air swirler having a radial fuel inlet disposed in flow communication with a respective one of said fuel outlets for receiving fuel radially therefrom, and each air swirler further having a plurality of swirl vanes to swirl air for mixing with said fuel from a corresponding one of said fuel inlets inside each said swirler.

12. An apparatus according to claim 11 wherein each of said fuel injectors further comprises a hollow stem for channeling said fuel, and a plurality of hollow spokes extending radially outwardly from said stem and in flow communication therewith, and said fuel outlets are disposed at respective outer ends of said spokes.

13. An apparatus according to claim 12 wherein each of said swirlers further comprises:

a tubular body including said fuel inlet extending radially therethrough;

a row of first swirl vanes disposed coaxially with said body for swirling a portion of said air into said body;

a row of second swirl vanes disposed coaxially with said body and spaced from said first swirl vanes for swirling another portion of said air into said body; and said fuel inlet is disposed axially between said rows of first and second swirl vanes for injecting fuel therebetween for mixing therewith and ejection from a common outlet of said body as a fuel and air mixture.

14. An apparatus according to claim 13 further comprising four of said swirlers disposed in flow communication with each of said fuel injectors.

15. A carburetor comprising:

a fuel injector having a plurality of radial fuel outlets; and a plurality of air swirlers circumferentially spaced apart around said fuel injector, and each having a radial fuel inlet disposed in flow communication with a respective one of said fuel outlets for receiving fuel radially therefrom, and each further having a plurality of swirl vanes to swirl air for mixing with said fuel from said fuel inlet.

16. A carburetor according to claim 15 wherein said fuel injector further comprises a hollow stem for channeling said fuel, and a plurality of hollow spokes extending radially outwardly from said stem and in flow communication therewith, and said fuel outlets are disposed at respective outer ends of said spokes.

17. A carburetor according to claim 16 wherein each of said swirlers further comprises:

a tubular body including said fuel inlet extending radially therethrough;

a row of first swirl vanes disposed coaxially with said body for swirling a portion of said air into said body; and a row of second swirl vanes disposed coaxially with said body and spaced from said first swirl vanes for swirling another portion of said air into said body.

18. A carburetor according to claim 17 wherein each of said swirler fuel inlets is disposed axially between said rows of first and second swirl vanes for injecting said fuel therebetween for mixing therewith from a common outlet of each of said bodies as respective fuel and air mixtures.

* * * * *